United States Patent [19]

Ebner

[11] Patent Number: 4,571,273

[45] Date of Patent: Feb. 18, 1986

[54] PROCESS OF HEATING AND COOLING CHARGES IN BATCH-PROCESS INDUSTRIAL FURNACES

[75] Inventor: Peter Ebner, Leonding, Austria

[73] Assignee: Ebner-Industrieofenbau Ing. Josef Ebner KG, Leonding, Austria

[21] Appl. No.: 624,590

[22] Filed: Jun. 26, 1984

[30] Foreign Application Priority Data

Jul. 5, 1983 [AT] Austria ..... 2457/83

[51] Int. Cl.[4] ..... C21D 1/76

[52] U.S. Cl. ..... 148/16; 148/16.7; 148/20.3; 148/27; 432/23

[58] Field of Search ..... 148/16, 14, 16.7, 13.1, 148/27, 143, 157, 20.3; 34/20, 22, 16, 29, 36, 15; 432/19, 23, 42, 48, 206

[56] References Cited

U.S. PATENT DOCUMENTS

| | | | |
|---|---|---|---|
| 3,873,377 | 3/1975 | Fisher et al. | 148/16.7 |
| 3,966,509 | 6/1976 | Podgurski | 148/16 |
| 3,986,900 | 10/1976 | Rademacher | 148/16 |
| 4,183,773 | 1/1980 | Kawasoko et al. | 148/16 |

FOREIGN PATENT DOCUMENTS

| | | | |
|---|---|---|---|
| 3105064 | 9/1982 | Fed. Rep. of Germany . | |
| 9325 | 1/1981 | Japan | 148/27 |
| 9324 | 1/1981 | Japan | 148/16 |
| 44724 | 4/1981 | Japan | 148/16 |
| 126930 | 7/1983 | Japan | 148/16 |

*Primary Examiner*—Christopher W. Brody
*Attorney, Agent, or Firm*—Kurt Kelman

[57] ABSTRACT

In a process of heating and cooling charges in batch-process industrial furnaces, particularly in a process of cooling coils of steel wire or strip steel in bell-type annealing furnaces, the charge is heated and cooled in contact with circulated protective gas. The cooling time is shortened and the power input to the circulating fan is reduced by changing the composition of the protective gas so as to decrease the specific gravity of the protective gas just before the beginning of the cooling period and/or during the cooling period.

5 Claims, 2 Drawing Figures

FIG.1
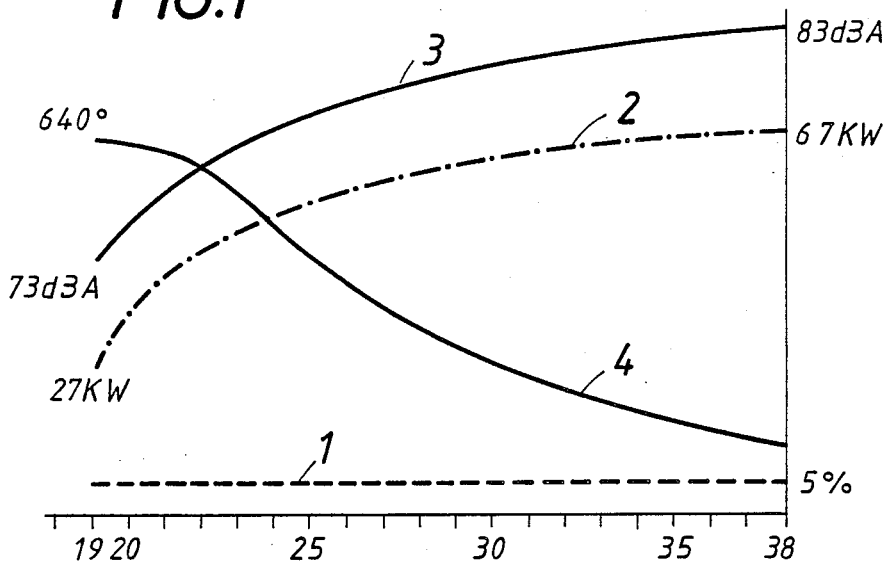
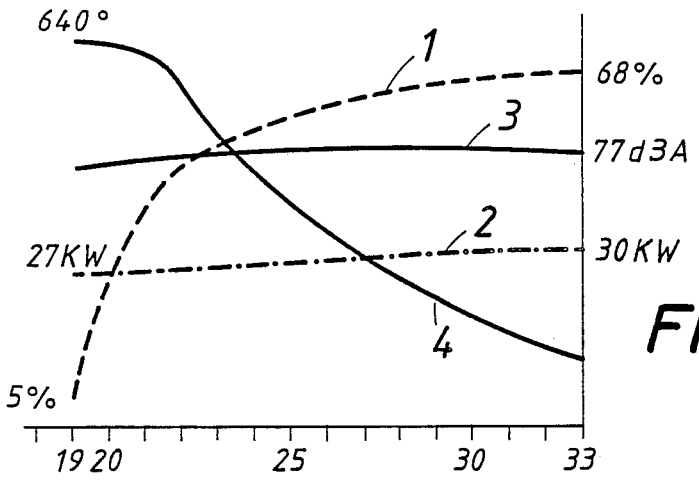
FIG.2

PROCESS OF HEATING AND COOLING CHARGES IN BATCH-PROCESS INDUSTRIAL FURNACES

This invention relates to a process of heating and cooling charges in batch-process industrial furnaces, particularly to a process of cooling coils of steel wire or strip steel in bell-type annealing furnaces, wherein the charge is heated and cooled in a circulating protective gas atmosphere.

The heating of metal charges in industrial furnaces, preferably for bright annealing, is usually carried out in a protective gas atmosphere, which consists in most cases of nitrogen that contains 0.5 to 7.0 vol.% hydrogen. The heating or annealing period is then succeeded by a cooling period. If the composition of the protective gas was not changed throughout the process, the contraction of the protective gas that is caused by the cooling is compensated by a supply of the same protective gas so that the same protective gas is always made available in the supply line. That practice has the disadvantage that a relatively long cooling time is required as well as a relatively high power input to the fan, which is operated to circulate the protective gas during the cooling period.

It is an object of the invention to provide a process by which the cooling time can be shortened and the power input to the circulating fan can be reduced.

This object is accomplished in accordance with the invention by changing the composition of the protective gas so as to decrease the specific gravity of the protective gas before the beginning of the cooling period and/or during the cooling period.

The use of a protective gas having a lower specific gravity results in an improved dissipation of heat so that the cooling time is shortened, as is desired, and the lower specific gravity reduces the real power input to the motor of the circulating fan, particularly because a large part of the power input is converted to heat.

The process in accordance with the invention can be carried out in various ways. In a particularly desirable mode of carrying out the process, the reduction in volume of the protective gas that has been used during the heating of the charge, which reduction in volume is due to the contraction caused by the cooling, is continually compensated by the supply of a make-up protective gas which has a lower specific gravity. Alternatively, at least part of the protective gas used during the heating of the charge is replaced before the cooling operation by a replacement protective gas which has a lower specific gravity. Such protective gas having a lower specific gravity may consist, e.g., of hydrogen or dissociated ammonia gas.

If hydrogen is used as a replacement or make-up protective gas, the furnace chamber is scavenged with nitrogen or evacuated at the end of the cooling period so that the protective gas atmosphere is adjusted to an incombustible composition.

Whereas it is known to replace the atmosphere during the cooling operation, the known practice calls for a supply of $CO_2$ in the form of a foam, which is evaporated to effect a faster cooling. This will obviously not result in a decrease of the specific gravity.

The drawing illustrates by way of example the difference between the conventional cooling operation and the process in accordance with the invention in two graphs.

FIG. 1 shows the curves for a coventional bell-type annealing furnace in which the composition of the protective gas is not changed and FIG. 2 shows corresponding curves for the process in accordance with the invention.

The invention will now be explained with reference to an example.

EXAMPLE

In a high-convection bell-type annealing furnace, a strip steel coil was heated to about 640° C. in a protective gas atmosphere consisting of $N_2$ and 5 vol.% $H_2$. A protective gas having the same composition was used in the cooling operation, which lasted 18 hours. During that time the real power input of the motor of the circulating fan rose from 27 kW to 67 kW and the total energy consumption of that motor during the cooling period amounted to 980 kWh. At the end of the cooling period, a noise level of the fan amounting to 83 dBA was measured.

For comparison, an annealing operation carried out under the same conditions was succeeded by a cooling operation in which the reduction in volume of the protective gas resulting from its contraction was compensated by a supply of hydrogen. As a result, it was possible to reduce the cooling time to 13 hours and the real power input of the fan motor increased only to 30 kW so that the total energy consumption of the fan during the cooling period amounted to 360 kWh. The noise level at the end of the cooling period was decreased by 6 dBA.

This comparison shows that the process according to the invention resulted in a decrease of the cooling time to 72% and in a reduction of the energy consumption of the fan to 37%.

On the drawings, the time in hours is plotted along the x-axis. The temperature in degrees Centrigrade, the $H_2$ content in vol.%, the real power input to the fan motor in kW and the noise level in dBA are plotted along the y-axis. Only the cooling period is illustrated.

In accordance with FIG. 1 the hydrogen content under the protective hood, plotted as curve 1, remains constant and the real power input to the fan motor, plotted as curve 2, rises considerably until the end of the cooling period. On the other hand, in accordance with FIG. 2 the real power input to the fan motor, plotted as curve 2, remains almost constant but the hydrogen cntent, plotted as curve 1, rises strongly and the entire cooling time is greatly shortened. The noise level is plotted as curve 3 and the charge temperature level is plotted as curve 4.

I claim:

1. In a batch-process of heating and subsequently cooling a charge in a bell-type annealing furnace during a heating period and a succeeding cooling period, wherein a protective gas is circulated through said furnace in contact with said charge during said heating and cooling periods, and wherein the improvement comprises changing the composition of said protective gas to decrease its specific gravity between the end of said heating period and the end of said cooling period by admixing a make-up protective gas having a lower specific gravity than the protective gas circulated through said furnace during said heating period to said circulated protective gas.

2. The improvement set forth in claim 1, wherein said make-up protective gas is admixed to said circulated protective gas during said cooling period at such a rate that any reduction in volume of said protective gas caused by a contraction of said protective gas during said cooling period is compensated.

3. The improvement set forth in claim 1, wherein at least part of said protective gas circulated through said furnace during said heating period is replaced by said make-up protective gas having a lower specific gravity between the end of said heating period and the beginning of said cooling period.

4. The improvement set forth in claim 1, wherein the composition of said protective gas is changed by a supply of hydrogen to said furnace to decrease the specific gravity of said protective gas between the end of said heating period and the end of said cooling period and said furnace is scavenged with nitrogen after the end of said cooling period.

5. The improvement set forth in claim 1, wherein the composition of said protective gas is changed by a supply of hydrogen to said furnace to decrease the specific gravity of said protective gas between the end of said heating period and the end of said cooling period and said furnace is evacuated after the end of said cooling period.

* * * * *